US007742035B2

(12) United States Patent
Wu et al.

(10) Patent No.: US 7,742,035 B2
(45) Date of Patent: Jun. 22, 2010

(54) LIQUID CRYSTAL DISPLAY AND DRIVING METHOD THEREOF FOR ADJUSTING REFRESH RATE AND LUMINANCE ACCORDING TO THAT OF AMBIENT LIGHT

(75) Inventors: Kuo-Jung Wu, Miao-Li (TW); Shie De-Ching, Miao-Li (TW)

(73) Assignee: Innolux Display Corp., Miao-Li County (TW)

( * ) Notice: Subject to any disclaimer, the term of this patent is extended or adjusted under 35 U.S.C. 154(b) by 606 days.

(21) Appl. No.: 11/645,370

(22) Filed: Dec. 26, 2006

(65) Prior Publication Data

US 2007/0146300 A1 Jun. 28, 2007

(30) Foreign Application Priority Data

Dec. 23, 2005 (TW) ..... 94146296 A

(51) Int. Cl.
*G09G 3/36* (2006.01)

(52) U.S. Cl. ..... 345/102; 345/87

(58) Field of Classification Search ..... 345/87–102
See application file for complete search history.

(56) References Cited

U.S. PATENT DOCUMENTS

| | | | | |
|---|---|---|---|---|
| 6,144,359 | A * | 11/2000 | Grave | 345/102 |
| 6,870,529 | B1 * | 3/2005 | Davis | 345/207 |
| 7,397,021 | B2 * | 7/2008 | Shibata | 250/238 |
| 7,468,721 | B2 * | 12/2008 | Nakano | 345/102 |
| 7,511,695 | B2 * | 3/2009 | Furukawa et al. | 345/102 |
| 7,551,158 | B2 * | 6/2009 | Nishimura et al. | 345/102 |
| 2002/0011978 | A1 | 1/2002 | Yamazaki et al. | |
| 2004/0145560 | A1 | 7/2004 | Kim | |
| 2005/0116910 | A1 | 6/2005 | Lee et al. | |
| 2005/0134547 | A1 * | 6/2005 | Wyatt | 345/102 |
| 2006/0097978 | A1 * | 5/2006 | Ng et al. | 345/102 |
| 2006/0132414 | A1 * | 6/2006 | Yiu | 345/98 |
| 2006/0151678 | A1 * | 7/2006 | Shibata | 250/205 |
| 2007/0091055 | A1 * | 4/2007 | Sakuda | 345/102 |
| 2008/0129942 | A1 * | 6/2008 | Shin | 349/139 |

FOREIGN PATENT DOCUMENTS

| | | | |
|---|---|---|---|
| CN | 1517968 | A | 8/2004 |
| CN | 1519623 | A | 8/2004 |
| JP | 3092820 | A | 4/1991 |
| JP | 5299179 | A | 11/1993 |
| JP | 6282231 | A | 10/1994 |
| JP | 11295691 | A | 10/1999 |

* cited by examiner

*Primary Examiner*—Nitin Patel
(74) *Attorney, Agent, or Firm*—Wei Te Chung

(57) ABSTRACT

An exemplary liquid crystal display (200) includes a liquid crystal (LC) panel (210), a gate driving circuit (220) for scanning the liquid crystal panel, a data driving circuit (230) for providing a plurality of gradation voltages to the liquid crystal panel, an photo sensor (250) configured for measuring a frequency and a luminance of ambient light and generating a measurement signal, a timing control circuit (240) configured for controlling the gate driving circuit and the data driving circuit, and a backlight module driving circuit (270) for driving a light source (260) to emit light beams for illuminating the liquid crystal panel. One of the timing control circuit and the backlight module driving circuit is configured for receiving the measurement signal and adjusting a refresh rate and a luminance of the LC panel according to the frequency and the luminance of the ambient light.

17 Claims, 5 Drawing Sheets

LIQUID CRYSTAL DISPLAY AND DRIVING METHOD THEREOF FOR ADJUSTING REFRESH RATE AND LUMINANCE ACCORDING TO THAT OF AMBIENT LIGHT

FIELD OF THE INVENTION

The present invention relates to a liquid crystal display (LCD) and a driving method of the LCD for adjusting a refresh rate and a luminance of a display screen of the active matrix LCD according to the refresh rate and the frequency of the ambient light.

GENERAL BACKGROUND

An active matrix LCD device has the advantages of portability, low power consumption, and low radiation, and has been widely used in various portable information products such as notebooks, personal digital assistants (PDAs), video cameras and the like. Furthermore, the active matrix LCD device is considered by many to have the potential to completely replace CRT (cathode ray tube) monitors and televisions.

FIG. 7 is an abbreviated block diagram of certain parts of a typical active matrix LCD. The LCD 100 includes a liquid crystal (LC) panel 110, a gate driving circuit 120, a data driving circuit 130, and a timing control circuit 140, a light source 160, and a backlight module driving circuit 170. The backlight module driving circuit 170 drives the light source 160 to emit light beams for illuminating the LC panel 110. The timing control circuit 140 is used to control the gate driving circuit 120 and the data driving circuit 130. The gate driving circuit 120 provides a plurality of scanning signals to the LC panel 110. The data driving circuit 130 provides a plurality of gradation voltages to the LC panel 110 when the LC panel 110 is scanned.

An image shown on a display screen of the active matrix LCD 100 is refreshed (i.e. replaced by a new identical image) at a predetermined frequency. In particular, the LCD 100 normally works with a predetermined refresh rate such as sixty hertz, seventy-five hertz, or another similar refresh rate. When a frequency of ambient light is changed from a first frequency such as fifty-five hertz to a second frequency such as seventy-five hertz, the LCD 100 does not adjust the refresh rate thereof to adapt to the frequency of the ambient light. Thus a user may find that his or her eyes easily become tired.

What is needed, therefore, is an LCD that can overcome the above-described deficiency.

SUMMARY

In one preferred embodiment, a liquid crystal display includes a liquid crystal panel, a gate driving circuit configured for scanning the liquid crystal panel, a data driving circuit configured for providing a plurality of gradation voltages to the liquid crystal panel, an photo sensor configured for measuring a frequency and a luminance of ambient light and generating a measurement signal, a timing control circuit configured for controlling the gate driving circuit and the data driving circuit, and a backlight module driving circuit for driving a light source to emit light beams for illuminating the liquid crystal panel. One of the timing control circuit and the backlight module driving circuit is configured for receiving the measurement signal and adjusting a refresh rate and a luminance of images on a display screen of the LCD panel according to the frequency and the luminance of the ambient light.

A driving method of the liquid crystal display includes the steps of: a) detecting a frequency and a luminance of the ambient light by the photo sensor, and generating a corresponding measurement signal representing the frequency and the luminance of the ambient light to one of the timing control circuit and the backlight module driving circuit; b) amplifying the measurement signal; c) determining the frequency and luminance of the ambient light according to measurement signal; and d) adjusting the refresh rate and the luminance of the display screen of the liquid crystal panel according to the measurement signal via control by the timing control circuit or the backlight module driving circuit.

Other advantages and novel features will become more apparent from the following detailed description when taken in conjunction with the accompanying drawings.

DETAILED DESCRIPTION OF PREFERRED EMBODIMENTS

Figure 1:
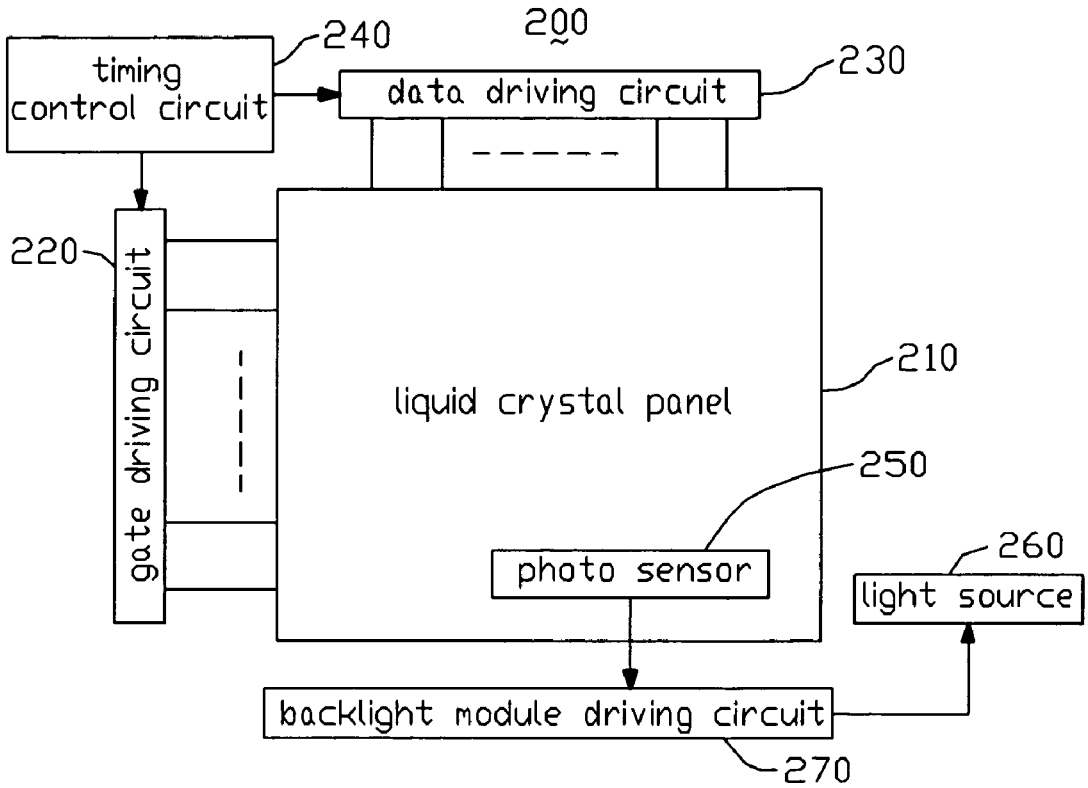
FIG. 1 is an abbreviated block diagram of certain parts of an active matrix LCD according to a first embodiment of the present invention, the LCD including a timing control circuit.

FIG. 1 is an abbreviated block diagram of certain parts of an active matrix LCD according to a first embodiment of the present invention. The active matrix LCD 200 includes a liquid crystal (LC) panel 210. The active matrix LCD 200 is configured such that an image shown on a display screen (not shown) of the LC panel 210 is refreshed at a predetermined frequency. The active matrix LCD 200 also includes a gate driving circuit 220, a data driving circuit 230, a timing control circuit 240, an photo sensor 250, a light source 260, and a backlight module driving circuit 270. The photo sensor 250 is positioned on the LC panel 210 and is electrically coupled to the backlight module driving circuit 270. The backlight module driving circuit 270 drives the light source 260 to emit light beams for illuminating the LC panel 210. The light source 260 may be a light emitting diode (LED), or a cold cathode fluorescent lamp (CCFL).

The timing control circuit 240 controls the gate driving circuit 220 and the data driving circuit 230. The gate driving circuit 220 provides a plurality of scanning signals to the LC panel 210. The data driving circuit 230 provides a plurality of gradation voltages to the LC panel 210 when the LC panel 210 is scanned. The photo sensor 250 is configured for measuring a frequency and a luminance of ambient light, and providing a measurement signal representing the frequency and the luminance of the ambient light to the backlight module driving circuit 270. Thus the backlight module driving circuit 270 synchronously adjusts the refresh rate and the luminance of the light source 260 according to the measurement signal. For example, when the frequency of the ambient light is fifty hertz, the refresh rate of the light source 260 can be set to sixty-seven hertz. If the luminance of the ambient light is low, the luminance of the light source 260 can be decreased according to the ambient light so as to decrease the luminance of the display screen of the LC panel 210. This can help a user comfortably view the display screen.

Figure 2:
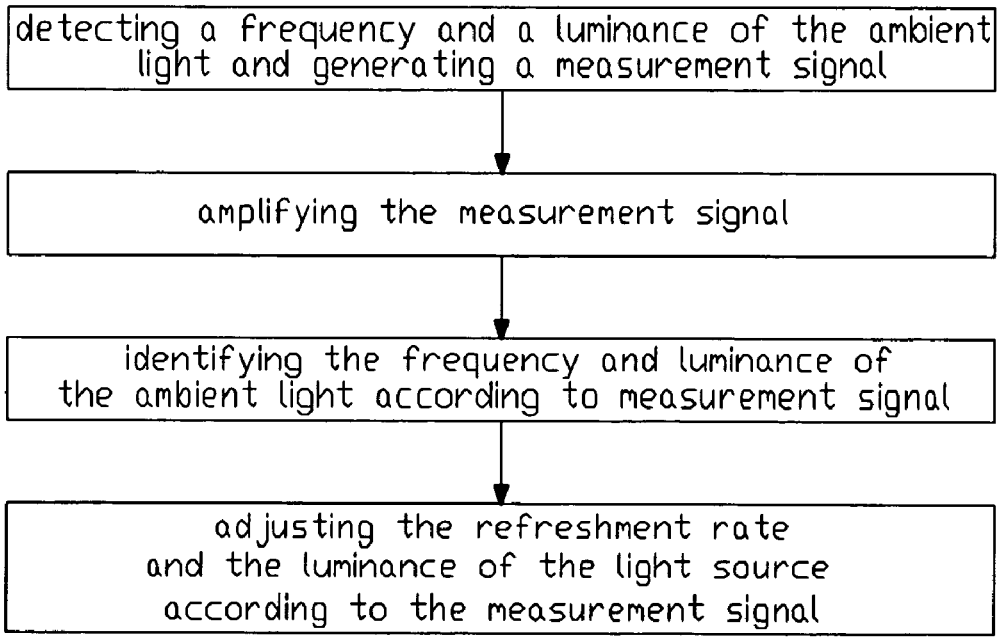
FIG. 2 is a flowchart of an exemplary driving method used to adjust a refresh rate and a luminance of the LCD of FIG. 1.

Referring to FIG. 2, a driving method used to adjust a refresh rate and a luminance of the LCD 200 includes the following steps: a) detecting a frequency and a luminance of the ambient light by the photo sensor 250, and generating a measurement signal representing the frequency and the luminance of the ambient light to the backlight module driving circuit 270; b) amplifying the measurement signal in the backlight module driving circuit 270; c) determining the frequency and luminance of the ambient light according to measurement signal; and d) adjusting the refresh rate and the luminance of the light source 260 according to the measurement signal via control by the backlight module driving circuit 270. That is, the refresh rate can be a selected refresh rate that generally corresponds to the frequency of the ambient light. Further, the refresh rate corresponding to a particular frequency of the ambient light can be determined in advance by a manufacturer of the active matrix LCD 200 or by a user.

Compared with the above-described conventional LCD 100, the LCD 200 use an photo sensor 250 to detect the frequency and the luminance of the ambient light, and then adjusts the refresh rate and the luminance of the light source via the backlight module driving circuit 270. This can help a user comfortably view the display screen of the LC panel 210 when the frequency and the luminance of the ambient light changes.

Figure 3:
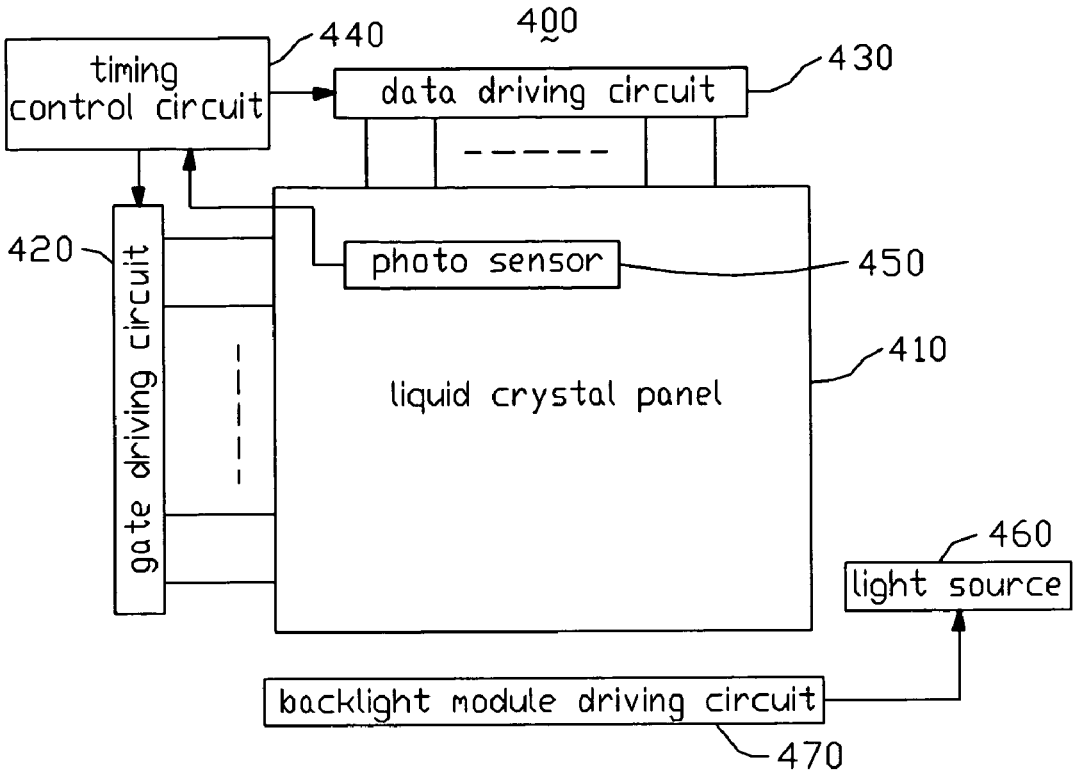
FIG. 3 is an abbreviated block diagram of certain parts of an active matrix LCD according to a second embodiment of the present invention.

FIG. 3 is an abbreviated block diagram of certain parts of an active matrix LCD according to a second embodiment of the present invention. The active matrix LCD 400 includes an LC panel 410, a gate driving circuit 420, a data driving circuit 430, a timing control circuit 440, an photo sensor 450, a light source 460, and a backlight module driving circuit 470. The photo sensor 450 is positioned on the LC panel 410 and is electrically coupled to the timing control circuit 440. The backlight module driving circuit 470 drives the light source 460 to emit light beams for illuminating the LC panel 410. The light source 460 may be a light emitting diode (LED), or a cold cathode fluorescent lamp (CCFL).

The timing control circuit 440 controls the gate driving circuit 420 and the data driving circuit 430. The gate driving circuit 420 provides a plurality of scanning signals to the LC panel 410. The data driving circuit 430 provides a plurality of gradation voltages to the LC panel 410 when the LC panel 410 is scanned. The photo sensor 450 is configured for measuring a frequency and a luminance of ambient light, and providing a measurement signal representing the frequency and the luminance of the ambient light to timing control circuit 440. Thus the timing control circuit 440 synchronously adjusts the refresh rate and the luminance of the LC panel 410 according to the measurement signal. For example, when the frequency of the ambient light is fifty hertz, the refresh rate of LC panel 410 can be set to sixty-seven hertz. If the luminance of the ambient light is low, the luminance of the LC panel 410 can be decreased according to the ambient light. This can help a user comfortably view a display screen of the LC panel 410.

Figure 4:
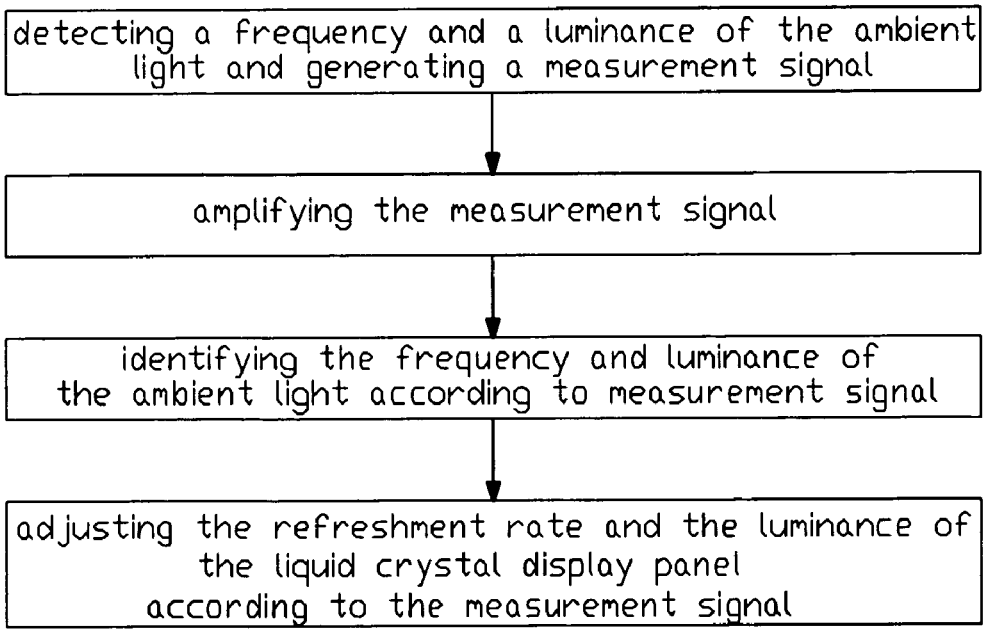
FIG. 4 is a flowchart of an exemplary method used to adjust a refresh rate and a luminance of the LCD of FIG. 3.

Referring to FIG. 4, a driving method used to adjust a refresh rate and a luminance of the LCD 200 includes the following steps: a) detecting a frequency and a luminance of the ambient light by the photo sensor 450, and generating a measurement signal representing the frequency and the luminance of the ambient light to the timing control circuit 440; b) amplifying the measurement signal in the timing control circuit 440; c) determining the frequency and luminance of the ambient light according to measurement signal; and d) adjusting the refresh rate and the luminance of the LC panel 410 according to the measurement signal via control of the gate driving circuit 420 and the data driving circuit 430 by the timing control circuit 440.

Compared with the above-described conventional LCD 100, the LCD 400 uses an photo sensor 450 to detect the frequency and the luminance of the ambient light, and then adjusts the refresh rate and the luminance of the LC panel 410 via the timing control circuit 440. This can help a user comfortably view the display screen of the LC panel 410 when the frequency and the luminance of the ambient light changes.

Figure 5:
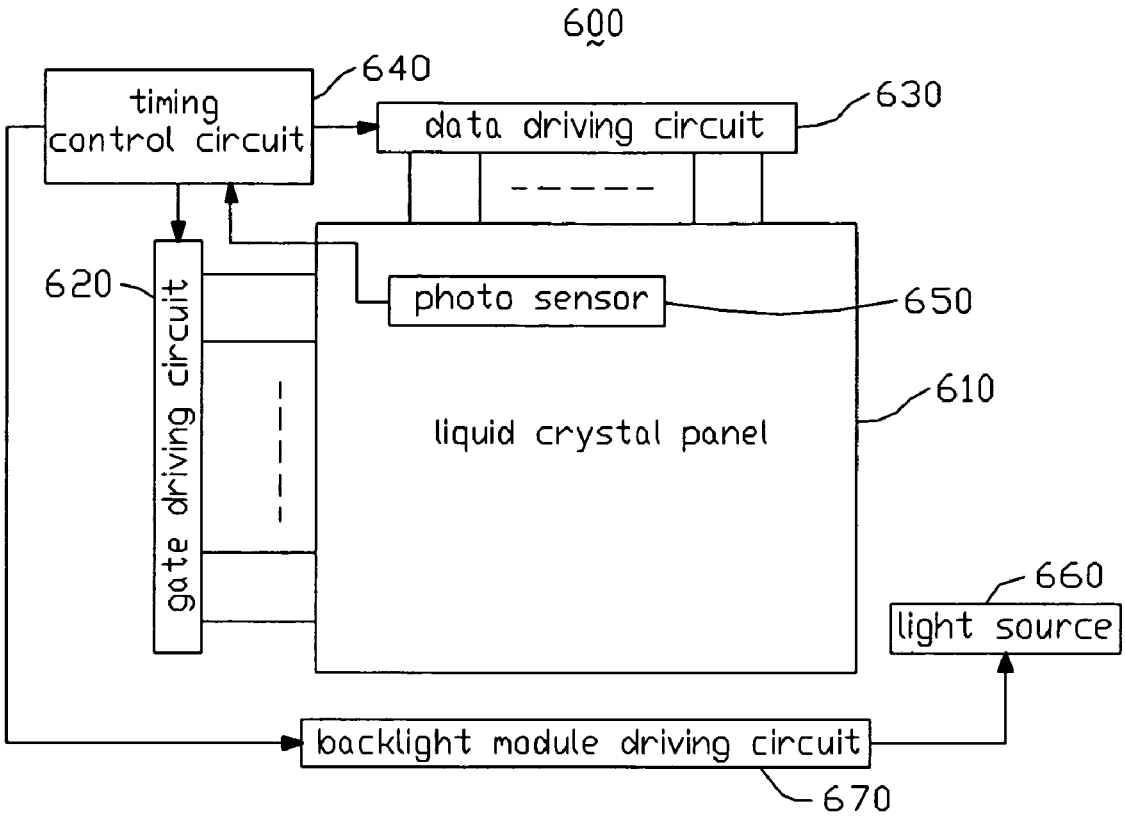
FIG. 5 is an abbreviated block diagram of certain parts of an active matrix LCD according to a third embodiment of the present invention.

FIG. 5 is an abbreviated block diagram of certain parts of an active matrix LCD according to a third embodiment of the present invention. The active matrix LCD 600 includes an LC panel 610, a gate driving circuit 620, a data driving circuit 630, a timing control circuit 640, an photo sensor 650, a light source 660, and a backlight module driving circuit 670. The photo sensor 650 is positioned on the LC panel 610 and is electrically coupled to the timing control circuit 640. The backlight module driving circuit 670 is electrically coupled to the timing control circuit 640. The backlight module driving circuit 670 drives the light source 660 to emit light beams for illuminating the LC panel 610. The light source 660 may be a light emitting diode (LED), or a cold cathode fluorescent lamp (CCFL).

The timing control circuit 640 controls the gate driving circuit 620, the data driving circuit 630, and the backlight module driving circuit 670. The gate driving circuit 620 provides a plurality of scanning signals to the LC panel 610. The data driving circuit 630 provides a plurality of gradation voltages to the LC panel 610 when the LC panel 610 is scanned. The photo sensor 650 is configured for measuring a frequency and a luminance of ambient light, and providing a measurement signal representing the frequency and the luminance of the ambient light to timing control circuit 640. Thus the timing control circuit 640 synchronously adjusts the refresh rate and the luminance of the LC panel 610 according to the measurement signal. Moreover, the timing control circuit 640 also transmits the measurement signal to the backlight module driving circuit 670. Thus the backlight module driving circuit 670 synchronously adjusts the refresh rate and the luminance of the light source 660 according to the measurement signal. The refresh rate of the light source 660 is synchronous to that of the LC panel 610.

Figure 6:
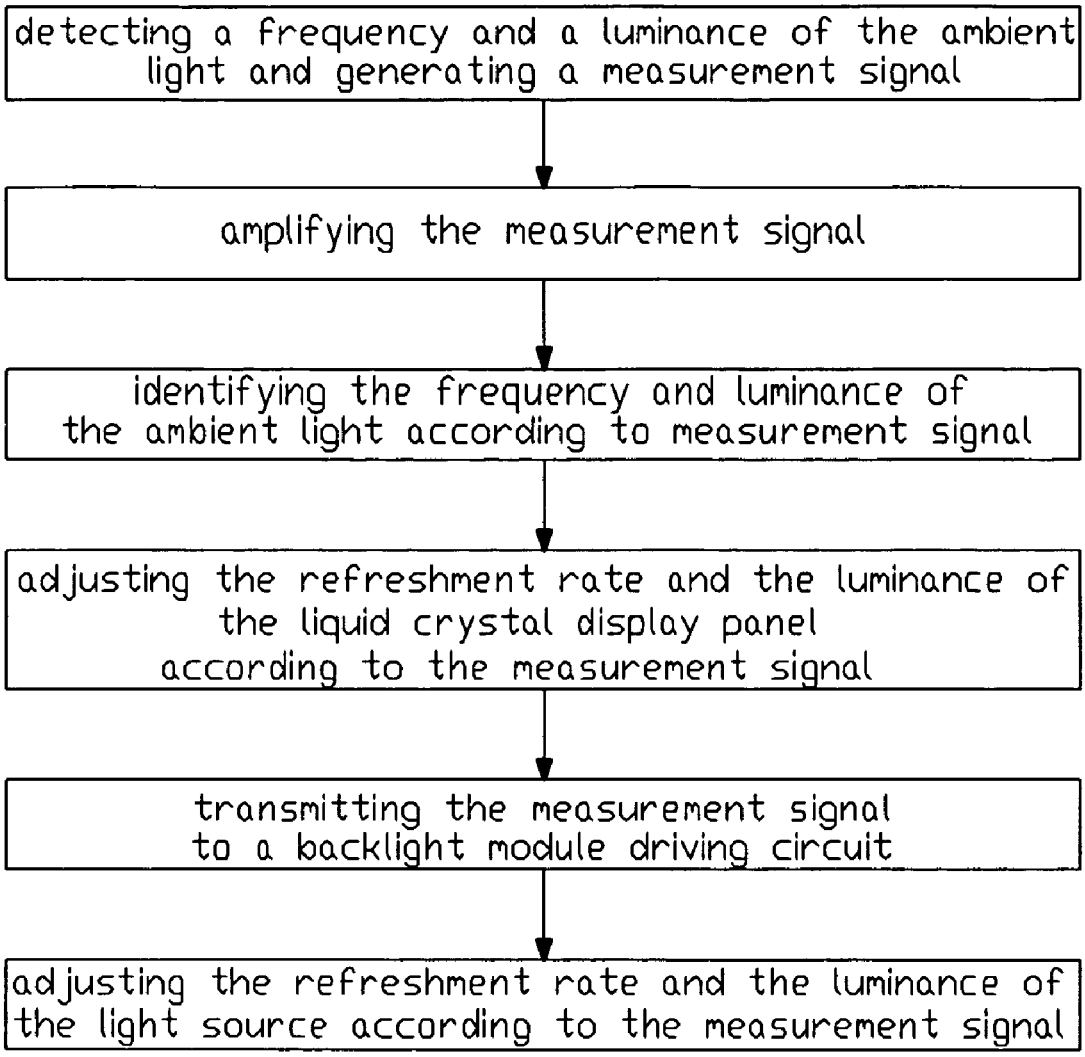
FIG. 6 is a flowchart of an exemplary driving method used to adjust a refresh rate and a luminance of the LCD of FIG. 5.
Figure 7:
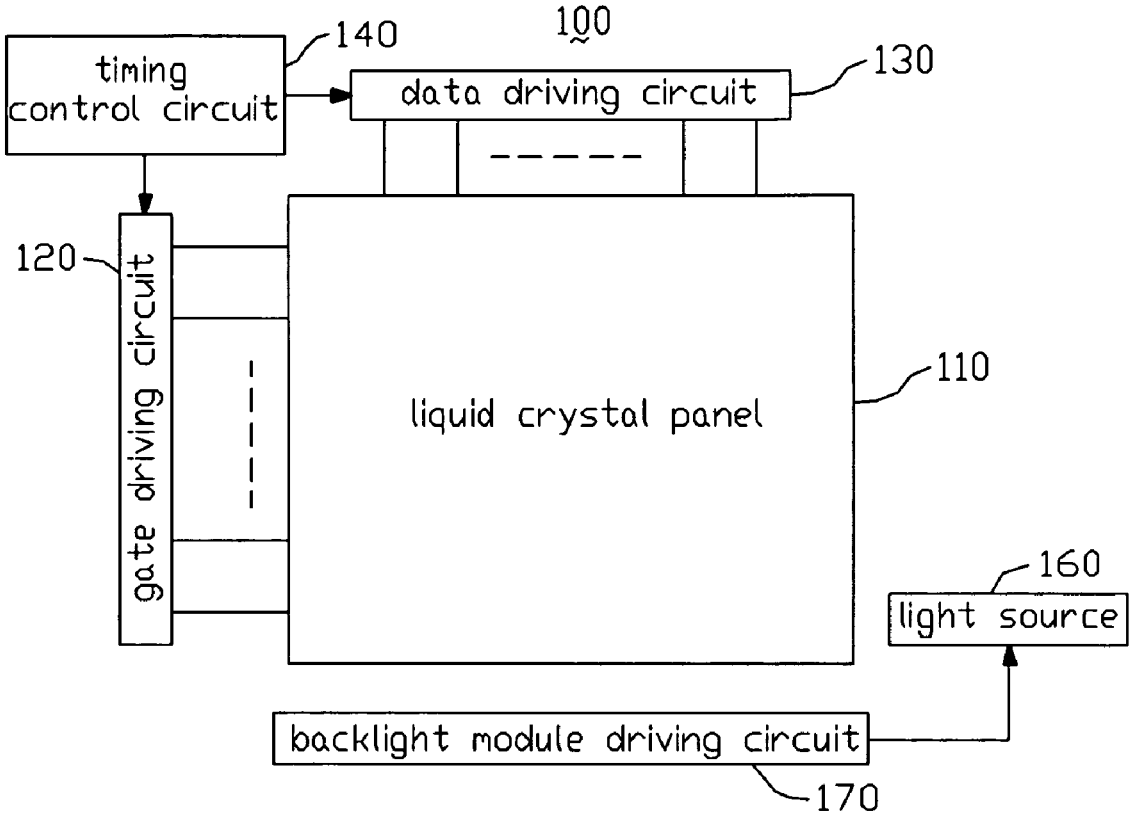
FIG. 7 (RELATED ART)
FIG. 7 is an abbreviated block diagram of certain parts of a conventional active matrix LCD.

Referring to FIG. 6, a driving method used to adjust a refresh rate and a luminance of the LCD 600 includes the following steps: a) detecting a frequency and a luminance of the ambient light by the photo sensor 650, and generating a measurement signal representing the frequency and the luminance of the ambient light to the timing control circuit 640; b) amplifying the measurement signal in the timing control circuit 640; c) determining the frequency and luminance of the ambient light according to measurement signal; d) adjusting the refresh rate and the luminance of the LC panel 610 according to the measurement signal via control of the gate driving circuit 620 and the data driving circuit 630 by the timing control circuit 640; e) transmitting the measurement signal from the timing control circuit 640 to the backlight module driving circuit 670; and f) adjusting the refresh rate and the luminance of the light source 660 according to the measurement signal via control by the backlight module driving circuit 670 synchronously with the adjustment of the refresh rate and the luminance of the LC panel 610 by the timing control circuit 640, wherein the refresh rate of the light source 660 is set to be equal to that of the LC panel 610.

Compared with the above-described conventional LCD 100, the LCD 600 use an photo sensor 650 to detect the frequency and the luminance of the ambient light, and then adjusts the refresh rate and the luminance of the LC panel 610 and the light source 660. This can help a user comfortably view a display screen of the LC panel 610 when the frequency and the luminance of the ambient light changes.

It is to be understood, however, that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid crystal display, comprising:

a liquid crystal panel;

a gate driving circuit configured for scanning the liquid crystal panel;

a data driving circuit configured for providing a plurality of gradation voltages to the liquid crystal panel;

an photo sensor configured for measuring a frequency and a luminance of ambient light and generating a corresponding measurement signal;

a timing control circuit configured for controlling the gate driving circuit and the data driving circuit; and a backlight module driving circuit for driving a light source to emit light beams for illuminating the liquid crystal panel;

wherein one of the timing control circuit and the backlight module driving circuit is configured for receiving the measurement signal and adjusting a refresh rate and a luminance of the liquid crystal panel according to the frequency and the luminance of the ambient light.

2. The liquid crystal display as claimed in claim 1, wherein the photo sensor is electrically coupled to the backlight module driving circuit, and the backlight module driving circuit receives the measurement signal of the photo sensor.

3. The liquid crystal display as claimed in claim 2, wherein the backlight module driving circuit adjusts the refresh rate and the luminance of the light source according to the measurement signal.

4. The liquid crystal display as claimed in claim 1, wherein the photo sensor is electrically coupled to the timing control circuit, and the timing control circuit receives the measurement signal of the photo sensor.

5. The liquid crystal display as claimed in claim 4, wherein the timing control circuit adjusts the refresh rate and the luminance of the liquid crystal panel according to the measurement signal.

6. The liquid crystal display as claimed in claim 5, wherein the timing control circuit transmits the measurement signal to the backlight module driving circuit.

7. The liquid crystal display as claimed in claim 6, wherein the backlight module driving circuit adjusts the refresh rate and the luminance of the light source according to the measurement signal synchronously with the adjustment of the refresh rate and the luminance of the liquid crystal panel by the timing control circuit.

8. The liquid crystal display as claimed in claim 7, wherein the backlight module driving circuit sets the refresh rate of the light source to be equal to that of the liquid crystal panel.

9. The liquid crystal display as claimed in claim 1, wherein the photo sensor is positioned on the liquid crystal panel.

10. A driving method for a liquid crystal display, the liquid crystal display comprising a liquid crystal panel, an photo sensor positioned with the liquid crystal panel, a timing control circuit, and a backlight module driving circuit, the driving method comprising:

detecting a frequency and a luminance of ambient light by the photo sensor, generating a corresponding measurement signal representing the frequency and the luminance of the ambient light, and transmitting the measurement signal to one of the timing control circuit and the backlight module driving circuit;

amplifying the measurement signal;

determining the frequency and luminance of the ambient light according to the measurement signal; and adjusting the refresh rate and the luminance of the liquid crystal panel according to the measurement signal via control by the timing control circuit or the backlight module driving circuit.

11. The driving method as claimed in claim 10, wherein the measurement signal is provided to the backlight module driving circuit.

12. The driving method as claimed in claim 11, wherein the backlight module driving circuit adjusts the refresh rate and the luminance of the light source according to the measurement signal.

13. The driving method as claimed in claim 10, wherein the measurement signal is provided to the timing control circuit.

14. The driving method as claimed in claim 11, wherein the timing control circuit adjusts the refresh rate and the luminance of the liquid crystal panel according to the measurement signal.

15. The driving method as claimed in claim 14, further comprising transmitting the measurement signal from the timing control circuit to the backlight module driving circuit.

16. The driving method as claimed in claim 15, further comprising adjusting the refresh rate and the luminance of the light source according to the measurement signal via control by the backlight module driving circuit synchronously with the adjustment of the refresh rate and the luminance of the liquid crystal panel by the timing control circuit.

17. The driving method as claimed in claim 16, wherein the backlight module driving circuit sets the refresh rate of the light source to be equal to that of the liquid crystal panel.

* * * * *